US009337585B1

(12) United States Patent
Yang

(10) Patent No.: US 9,337,585 B1
(45) Date of Patent: May 10, 2016

(54) TERMINAL STRUCTURE AND ELECTRICAL CONNECTOR HAVING THE SAME

(71) Applicant: ALL BEST PRECISION TECHNOLOGY CO., LTD., Taoyuan County (TW)

(72) Inventor: Haven Yang, New Taipei (TW)

(73) Assignee: ALL BEST PRECISION TECHNOLOGY CO., LTD., Taoyuan (TW)

( * ) Notice: Subject to any disclaimer, the term of this patent is extended or adjusted under 35 U.S.C. 154(b) by 0 days.

(21) Appl. No.: 14/561,481

(22) Filed: Dec. 5, 2014

(51) Int. Cl.
*H01R 24/00* (2011.01)
*H01R 13/6471* (2011.01)
*H01R 12/71* (2011.01)

(52) U.S. Cl.
CPC ..... *H01R 13/6471* (2013.01); *H01R 12/716* (2013.01)

(58) Field of Classification Search
CPC ..... H01R 13/6471; H01R 13/514; H01R 13/6461; H01R 13/6473; H01R 13/6485; H01R 13/6587; H01R 13/6596; H01R 23/02; H01R 24/60; H01R 9/0321
USPC ..... 439/660, 607.09, 101, 99, 939
See application file for complete search history.

(56) References Cited

U.S. PATENT DOCUMENTS 4,687,267 A * 8/1987 Header ..... H01R 12/725 439/607.07
5,114,355 A * 5/1992 Kimmel ..... H01R 23/6873 439/101
5,195,899 A * 3/1993 Yatsu ..... H01R 23/6873 439/101
5,618,202 A * 4/1997 Okuyama ..... H01R 23/662 439/497
6,074,225 A * 6/2000 Wu ..... H01R 23/6873 439/101
7,758,379 B2 * 7/2010 Chen ..... H01R 13/6485 439/607.11
7,833,065 B2 * 11/2010 Lin ..... H01R 13/65802 439/638
7,914,328 B2 * 3/2011 Tanaka ..... H01R 13/65802 439/607.08
8,109,795 B2 * 2/2012 Lin ..... H01R 13/6461 439/660
8,262,411 B2 * 9/2012 Kondo ..... H01R 13/6658 439/607.01
8,764,488 B2 * 7/2014 Zeng ..... H01R 13/6585 439/108
8,851,927 B2 * 10/2014 Hsu ..... H01R 13/6594 439/607.11
8,858,243 B2 * 10/2014 Luo ..... H01R 13/652 439/108

(Continued)

*Primary Examiner* — Neil Abrams
*Assistant Examiner* — Travis Chambers
(74) *Attorney, Agent, or Firm* — WPAT, P.C., Intellectual Property Attorneys; Anthony King

(57) ABSTRACT

A terminal structure includes ground terminals, signal terminals, connection elements, and ground electrical connection elements. The connection elements connect the ground terminals to the signal terminals, respectively. The ground electrical connection elements are in connection with connection elements and in electrical contact with at least a ground terminal. An electrical connector includes two terminal structures and a casing. The connection elements are connected to each other. An insertion slot is disposed on the front side of the casing. The terminal structure is disposed at the casing. The resilient ground electrical contact segments and the resilient signal electrical contact segments face the insertion slot. The ends of the ground electrical connection segments and the ends of the signal electrical connection segments are exposed from the casing. The terminal structure and the electrical connector improve resonance, adjust impedance, reduce signal loss, simplify die structures, and extend service life of a die.

17 Claims, 9 Drawing Sheets

(56) References Cited

U.S. PATENT DOCUMENTS 8,864,506 B2 * 10/2014 Little ..... H01R 13/6585 439/108
8,944,849 B1 * 2/2015 Yang ..... H01R 13/6588 439/607.07
8,968,031 B2 * 3/2015 Simmel ..... H01R 13/659 439/108
9,022,800 B2 * 5/2015 Yang ..... H01R 13/6581 439/487
9,178,310 B2 * 11/2015 Tsai ..... H01R 13/6315
9,209,573 B1 * 12/2015 Chen ..... H01R 13/6581
9,281,643 B1 * 3/2016 Tseng ..... H01R 24/78
9,300,091 B2 * 3/2016 Katayanagi ..... H01R 12/523
2014/0004744 A1 * 1/2014 Hsu ..... H01R 13/658 439/626
2015/0194772 A1 * 7/2015 Little ..... H01R 13/6597 439/357
2015/0244111 A1 * 8/2015 Ju ..... H01R 13/6585 439/607.05
2015/0255904 A1 * 9/2015 Ito ..... H01R 12/721 439/88
2015/0303629 A1 * 10/2015 MacDougall ..... H01R 13/6581 439/607.01
2016/0006195 A1 * 1/2016 Zhao ..... H01R 13/405 439/676
2016/0020560 A1 * 1/2016 Ju ..... H01R 24/78 439/607.05
2016/0036169 A1 * 2/2016 Hu ..... H01R 13/6585 439/607.05
2016/0049756 A1 * 2/2016 Yen ..... H01R 24/60 439/676
2016/0064864 A1 * 3/2016 Kao ..... H01R 13/6461 439/607.05

* cited by examiner

TERMINAL STRUCTURE AND ELECTRICAL CONNECTOR HAVING THE SAME

FIELD OF THE INVENTION

The present invention relates to terminal structures and electrical connectors having the terminal structures, and more particularly, to a terminal structure and an electrical connector having the terminal structure, which are capable of improving resonance, adjusting impedance, reducing signal loss, simplifying die structures, extending the service life of a die, speeding up a manufacturing process, and simplifying the process flow of a manufacturing process.

BACKGROUND OF THE INVENTION

With data communication being sophisticated nowadays, long-range data communication relies mostly upon wireless transmission devices, whereas short-range data communication usually requires electrical connectors. The terminal of a conventional electrical connector is typically disposed in the conventional electrical connector by an insert and injection process in a manner to provide two options of configuration: first, the terminal is enclosed in part; second, the terminal is enclosed in part and then exposed in part. However, as far as the terminal of a conventional electrical connector is concerned, ground terminals are predisposed to resonance for lack of electrical connection therebetween. Furthermore, in the situation where the terminal is enclosed in part, a plastic structure connected to the terminal adds to signal loss but prevents impedance from being adjusted. Also, in the situation where the terminal is enclosed in part and then exposed in part, its inherent drawbacks are as follows: first, a plastic structure encloses a portion of the terminal and thus precludes a reduction in signal loss; second, after a portion of the terminal has been enclosed, the process of exposing another portion of the terminal entails enclosing a portion of the terminal with a plastic structure and then removing a portion of the plastic structure with a die, and in consequence the process increases the complexity of a die, shortens the service life of a die, slows down a manufacturing process, and increases the complexity of the process flow of a manufacturing process. Accordingly, it is imperative to provide a terminal structure and an electrical connector having the terminal structure, which are capable of improving resonance, adjusting impedance, reducing signal loss, simplifying die structures, extending the service life of a die, speeding up a manufacturing process, and simplifying the process flow of a manufacturing process.

SUMMARY OF THE INVENTION

In view of the aforesaid drawbacks of the prior art, the inventor of the present invention conceived room for improvement in the prior art and thus conducted extensive researches and experiments according to the inventor's years of experience in the related industry, and finally developed a terminal structure and an electrical connector having the terminal structure, which are capable of improving resonance, adjusting impedance, reducing signal loss, simplifying die structures, extending the service life of a die, speeding up a manufacturing process, and simplifying the process flow of a manufacturing process.

In order to achieve the above and other objectives, the present invention provides, in a first aspect, a terminal structure which comprises: a plurality of ground terminals having resilient ground electrical contact segments and ground electrical connection segments connected to the resilient ground electrical contact segments, respectively; a plurality of signal terminals having resilient signal electrical contact segments and signal electrical connection segments connected to the resilient signal electrical contact segments, respectively, wherein the ground terminals alternate with the signal terminals transversely; a connection element for connecting each said ground terminal to a corresponding one of the signal terminals, wherein the connection element is a frame with a hollow-core region; and a ground electrical connection element having a ground body and at least a resilient ground pin, wherein the ground body is in connection with the frame, wherein the at least a resilient ground pin is in electrical contact with the ground terminals.

As regards the terminal structure, every two signal terminals are disposed between two said ground terminals.

As regards the terminal structure, the ground terminals and the signal terminals are longitudinally and penetratingly fixed to two sides of the frame and pass through the hollow-core region of the frame, wherein a first connection portion is disposed on one of two opened sides of the frame, wherein the ground body is in connection with the first connection portion, wherein the first connection portion has a plurality of connection posts or a plurality of connection slots.

As regards the terminal structure, the frame is disposed at the resilient ground electrical contact segments and the resilient signal electrical contact segments or disposed at the ground electrical connection segments and the signal electrical connection segments.

As regards the terminal structure, the frame is rectangular, wherein the ground terminals and the signal terminals are longitudinally and penetratingly fixed to two longer sides of the frame and pass through the hollow-core region of the frame.

As regards the terminal structure, the ground body has at least a hollow-core ground region, and the resilient ground pin is disposed in the hollow-core ground region to connect with the inner edge of the ground body and is in electrical contact with the ground terminals through the hollow-core region.

As regards the terminal structure, the ground body has at least a hollow-core ground region and a second connection portion, with the ground body overlapping the frame, wherein the second connection portion is connected to the first connection portion, wherein the resilient ground pin is disposed in the hollow-core ground region to connect with an inner edge of the ground body and is in electrical contact with the ground terminals through the hollow-core region.

According to the present invention, the second aspect provides an electrical connector which comprises: two said terminal structures, wherein the connection elements are connected to each other; and a casing having an insertion slot disposed on a front side of the casing, wherein the terminal structure is disposed at the casing, wherein the resilient ground electrical contact segments and the resilient signal electrical contact segments face the insertion slot, wherein the ends of the ground electrical connection segments and the ends of the signal electrical connection segments are exposed from the casing.

As regards the electrical connector, the connection elements clamp the ground electrical connection elements.

As regards the electrical connector, it further comprises a mounting base having a plurality of recesses spaced apart from each other transversely, wherein the ground electrical connection segments and the signal electrical connection segments are disposed in the recesses, respectively, wherein the mounting base is disposed on a rear side of the casing, wherein the ends of the ground electrical connection segments and the ends of the signal electrical connection segments are exposed from the mounting base.

As regards the electrical connector, a supporting element is disposed on each of two sides at a rear of the casing, wherein the supporting elements each have an engaging slot, wherein an engaging arm is disposed on each of two sides of the mounting base, wherein the engaging arms are engaged with the engaging slots, respectively, such that the mounting base is fixed to the rear of the casing.

As regards the electrical connector, a supporting element is disposed on each of two sides at a rear of the casing, wherein the supporting elements each have an engaging arm, wherein an engaging slot is disposed on each of two sides of the mounting base, wherein the engaging arms are engaged with the engaging slots, respectively, such that the mounting base is fixed to the rear of the casing.

Accordingly, the present invention provides a terminal structure and an electrical connector having the terminal structure, which are capable of improving resonance, adjusting impedance, reducing signal loss, simplifying die structures, extending the service life of a die, speeding up a manufacturing process, and simplifying the process flow of a manufacturing process.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
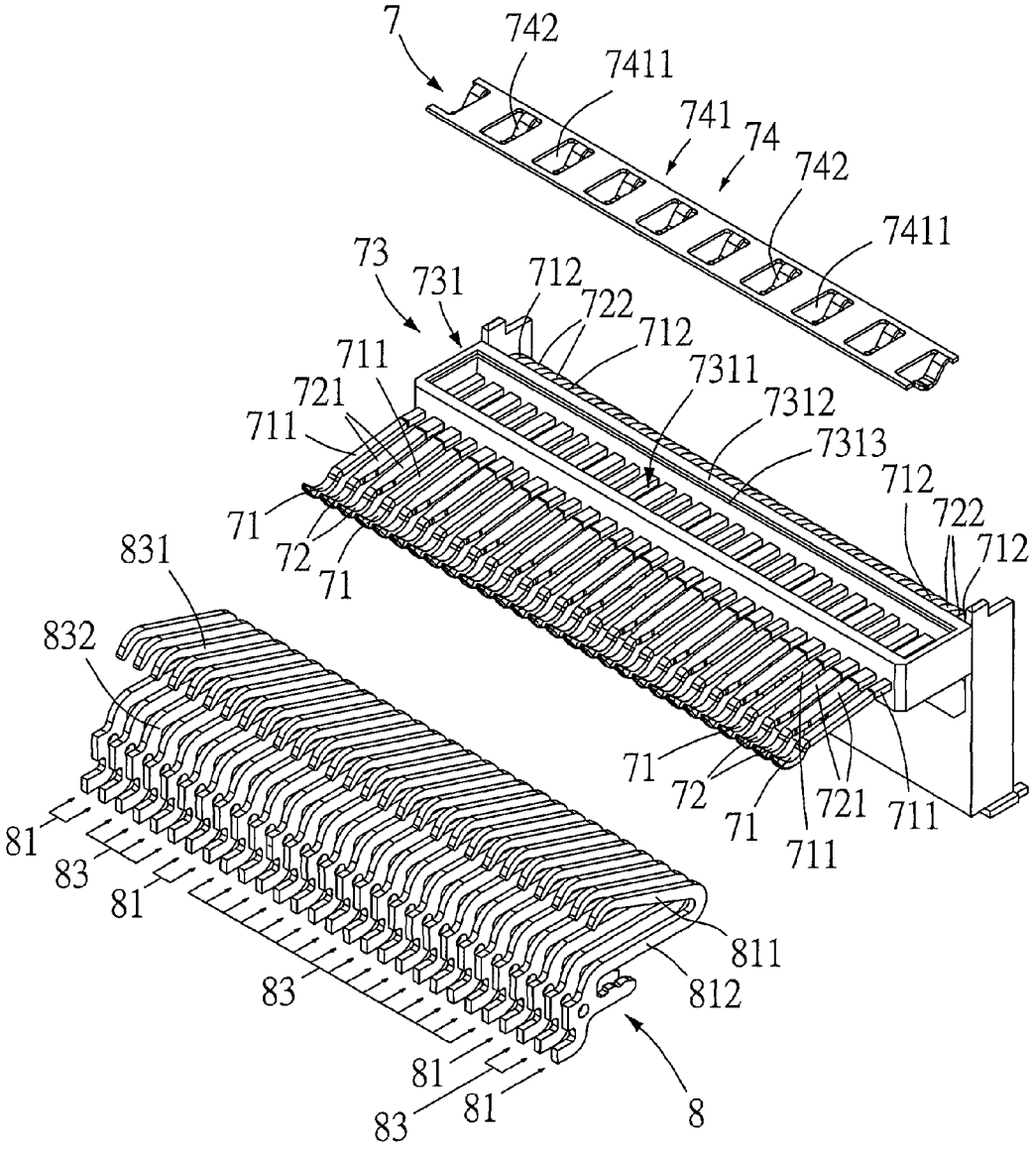
FIG. 1 is an exploded view of a preferred embodiment of the present invention.

Referring to FIG. 1, the present invention in the first aspect provides a terminal structure 7 which comprises a plurality of ground terminals 71, a plurality of signal terminals 72, a connection element 73, and a ground electrical connection element 74. The ground terminal 71 has an L shape and has a resilient ground electrical contact segment 711 and a ground electrical connection segment 712 connected to the resilient ground electrical contact segment 711. The resilient ground electrical contact segment 711 is formed by extending the ground terminal 71 horizontally. The ground electrical connection segment 712 is formed by extending the ground terminal 71 vertically. The resilient ground electrical contact segment 711 is adapted to come into electrical contact with an external plug or receptacle (not shown). The ground electrical connection segment 712 is adapted to electrically connect with a circuit board (not shown). The signal terminal 72 has an L shape and has a resilient signal electrical contact segment 721 and a signal electrical connection segment 722 connected to the resilient signal electrical contact segment 721. The resilient signal electrical contact segment 721 is formed by extending the signal terminal 72 horizontally. The signal electrical connection segment 722 is formed by extending the signal terminal 72 vertically. The resilient signal electrical contact segment 721 is adapted to come into electrical contact with an external plug or receptacle (not shown). The signal electrical connection segment 722 is adapted to electrically connect with the circuit board (not shown). The ground terminals 71 alternate with the signal terminals 72 transversely. Every two signal terminals 72 can be disposed between two said ground terminals 71. In addition, referring to FIG. 1, the present invention in the first aspect provides a terminal set 8 which comprises a plurality of ground terminals 81 and a plurality of function terminals 83. The function terminal 83 can be a power supply terminal, a signal terminal or other terminal. The ground terminal 81 has a V shape and has a resilient ground electrical contact segment 811 and a ground electrical connection segment 812 connected to the resilient ground electrical contact segment 811. The resilient ground electrical contact segment 811 is a top part of the ground terminal 81. The ground electrical connection segment 812 is a bottom part of the ground terminal 81. The resilient ground electrical contact segment 811 is adapted to come into electrical contact with an external plug or receptacle (not shown). The ground electrical connection segment 812 is adapted to electrically connect with a circuit board (not shown). The function terminal 83 has a V shape and has a resilient electrical contact segment 831 and an electrical connection segment 832 connected to the resilient electrical contact segment 831. The resilient electrical contact segment 831 is a top part of the function terminal 83. The electrical connection segment 832 is a bottom part of the function terminal 83. The resilient electrical contact segment 831 is adapted to come into electrical contact with an external plug or receptacle (not shown). The electrical connection segment 832 is adapted to electrically connect with the circuit board (not shown). The ground terminals 81 can alternate arbitrarily with the function terminals 83 transversely. The connection element 73 is made of a plastic and adapted to connect the ground terminals 71 and the signal terminals 72 by an insert and injection process. The ground terminals 71 and the signal terminals 72 are disposed in an electrical connector by means of the connection element 73. The connection element 73 is a frame 731 and has a hollow-core region 7311. The ground electrical connection element 74 has a ground body 741 and at least a resilient ground pin 742. The ground electrical connection element 74 has at least a hollow-core ground region 7411. The hollow-core ground region 7411 is in communication with the hollow-core region 7311 of the frame 731. The resilient ground pin 742 is disposed in the hollow-core ground region 7411 to connect with the inner edge of the ground body 741. The ground body 741 passes through an opened side 7312 of the frame 731 to dispose on an annular supporting flange 7313 inside the hollow-core region 7311 of the frame 731. The resilient ground pin 742 electrically contacts with the ground terminal 71.

Referring to FIG. 2 through FIG. 7, the present invention in the first aspect provides another set of terminal structures 1, 2 which comprise a plurality of ground terminals 11, 21, a plurality of signal terminals 12, 22, connection elements 13, 23, and ground electrical connection elements 14, 24, respectively. The ground terminals 11, 21 have resilient ground electrical contact segments 111, 211 and ground electrical connection segments 112, 212 connected to the resilient ground electrical contact segments 111, 211, respectively. The resilient ground electrical contact segments 111, 211 are formed by extending the ground terminals 11, 21 horizontally, respectively. The ground electrical connection segments 112, 212 are formed by extending the ground terminals 11, 21 vertically, respectively. The resilient ground electrical contact segments 111, 211 are adapted to come into electrical contact with an external plug or receptacle (not shown). The ground electrical connection segments 112, 212 are adapted to electrically connect with a circuit board 5. The signal terminals 12, 22 have resilient signal electrical contact segments 121, 221 and signal electrical connection segments 122, 222 connected to the resilient signal electrical contact segments 121, 221, respectively. The resilient signal electrical contact segments 121, 221 are formed by extending the signal terminals 12, 22 horizontally, respectively. The signal electrical connection segments 122, 222 are formed by extending the signal terminals 12, 22 vertically, respectively. The resilient signal electrical contact segments 121, 221 are adapted to come into electrical contact with an external plug or receptacle (not shown). The signal electrical connection segments 122, 222 are adapted to electrically connect with the circuit board 5. The ground terminals 11, 21 alternate with the signal terminals 12, 22 transversely. Every two signal terminals 12, 22 are disposed between two said ground terminals 11, 21, respectively. The connection elements 13, 23 are made of a plastic and adapted to connect the ground terminals 11, 21 and the signal terminals 12, 22 by an insert and injection process. The ground terminals 11, 21 and the signal terminals 12, 22 are disposed in an electrical connector by means of the connection elements 13, 23, respectively. The connection elements 13, 23 are frames 131, 231 and have hollow-core regions 1311, 2311, respectively. The ground electrical connection elements 14, 24 have ground bodies 141, 241 and resilient ground pins 142, 242, respectively. The ground bodies 141, 241 are in connection with the frames 131, 231, respectively. The resilient ground pins 142, 242 are in electrical contact with the ground terminals 11, 21, respectively.

As described before, according to the present invention, terminal structures 1, 2 get connected to the ground terminals 11, 21 through the ground electrical connection elements 14, 24, respectively, so as to improve resonance thereof.

Figure 2:
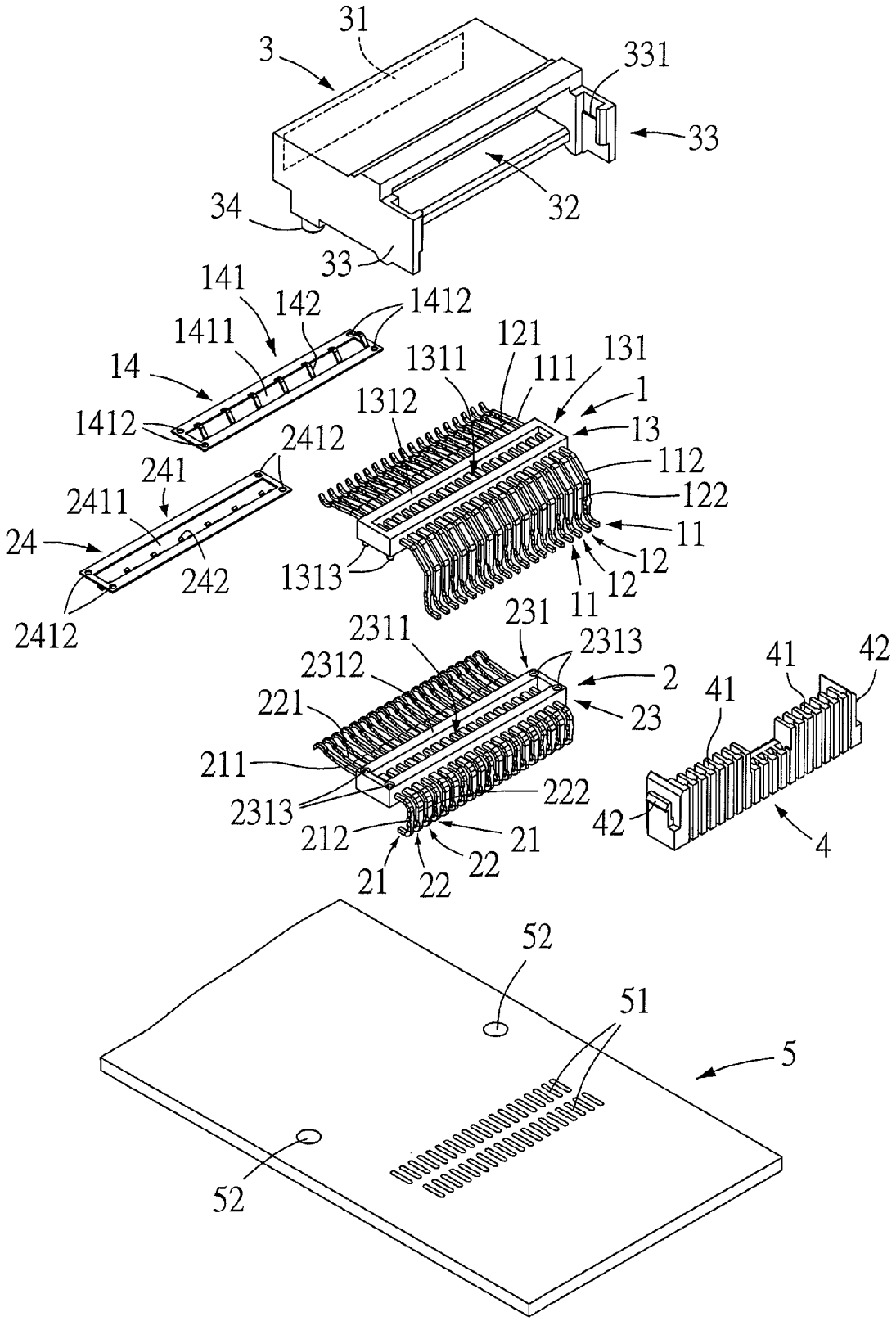
FIG. 2 is another exploded view of a preferred embodiment of the present invention.
Figure 3:
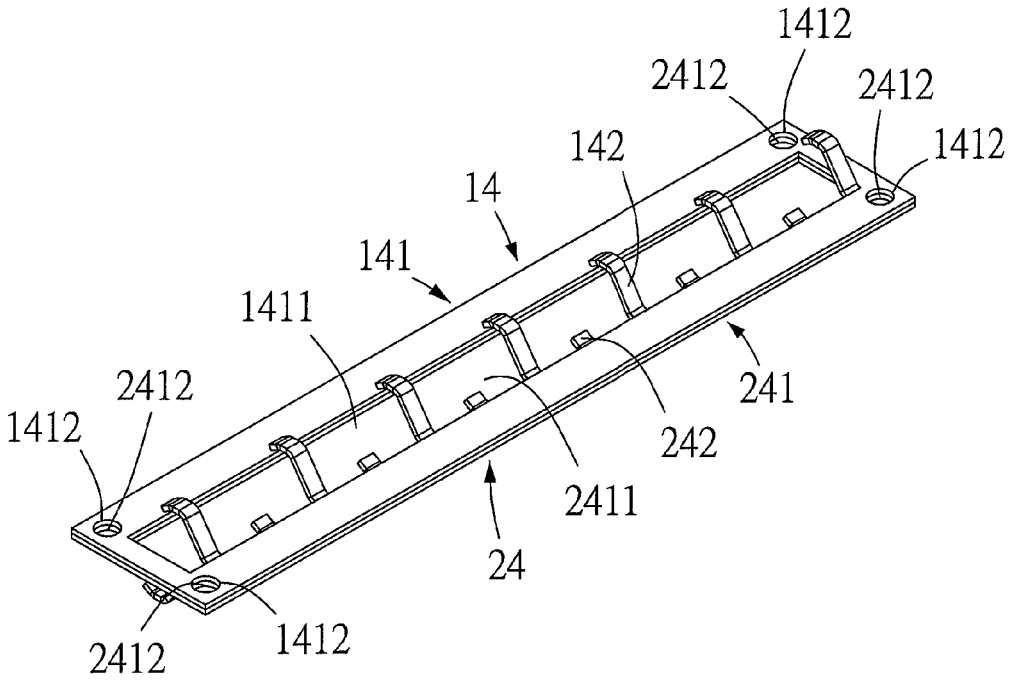
FIG. 3 is a perspective view of a ground electrical connection element according to a preferred embodiment of the present invention.
Figure 4:
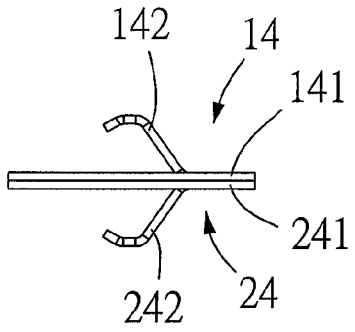
FIG. 4 is a front view of FIG. 3.
Figure 5:
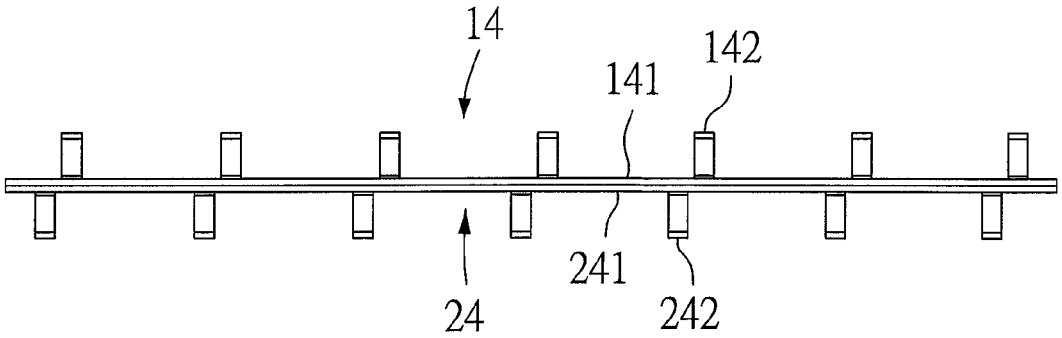
FIG. 5 is a right side view of FIG. 3.
Figure 6:
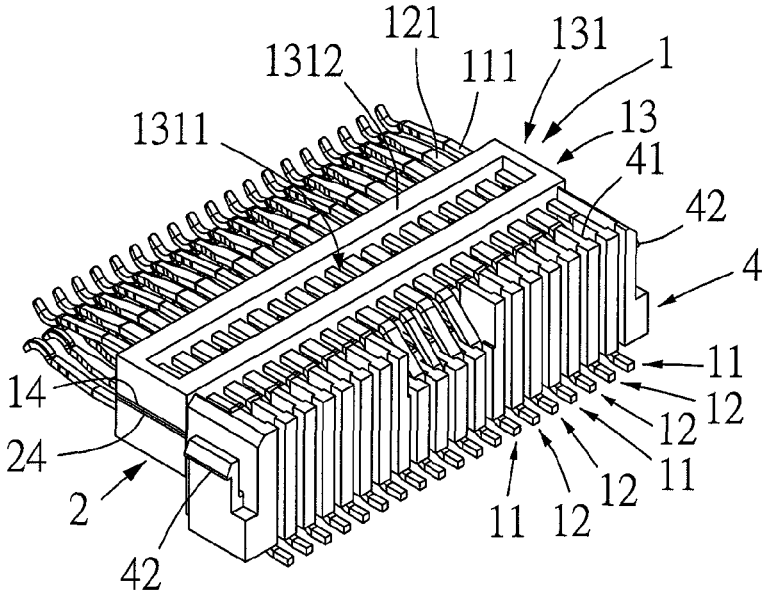
FIG. 6 is an assembled perspective of ground terminals, signal terminals, connection elements, ground electrical connection elements, and a mounting base according to a preferred embodiment of the present invention.
Figure 7:
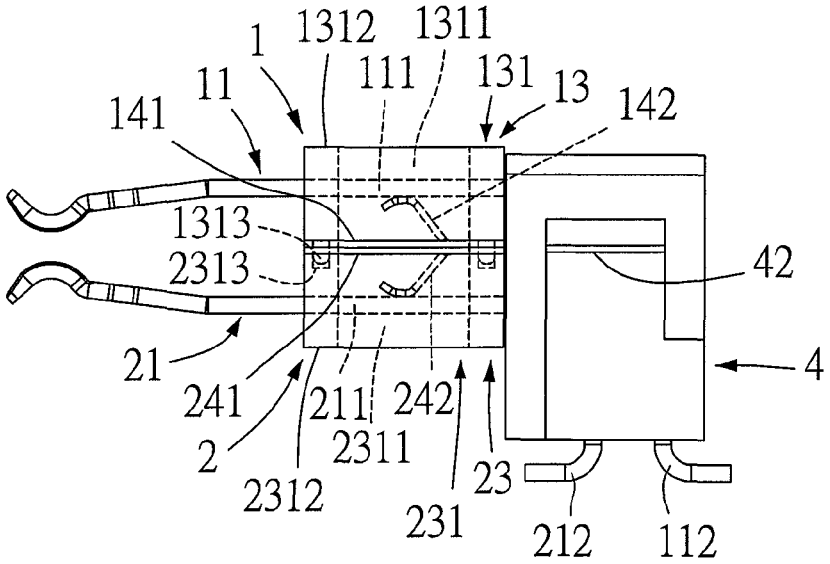
FIG. 7 is a front view of FIG. 6.

Referring to FIG. 2, FIG. 6, and FIG. 7, as regards the terminal structure, the ground terminals 11, 21 and the signal terminals 12, 22 are longitudinally and penetratingly fixed to the two sides of the frames 131, 231 and are passing through the hollow-core regions 1311, 2311 of the frames 131, 231, respectively. First connection portions 1313, 2313 are disposed at one of two opened sides 1312, 2312 of the frames 131, 231, respectively. The ground bodies 141, 241 are in connection with the first connection portions 1313, 2313, respectively. The first connection portions 1313, 2313 each have a plurality of connection posts or a plurality of connection slots. According to the present invention, the ground terminals 11, 21 and the signal terminals 12, 22 in the hollow-core regions 1311, 2311 of the frames 131, 231 of the terminal structures 1, 2 are fully exposed and thus are not enclosed by any plastic structure. According to the present invention, the terminal structures 1, 2 are conducive to reduction of signal loss. Furthermore, in the situation where the appearance of the frames 131, 231 remains unchanged, the terminal structures 1, 2 are characterized advantageously in that, by adjusting the size of the hollow-core regions 1311, 2311, it is practicable to change the length of the exposed portion of the ground terminals 11, 21 and the signal terminals 12, 22 in the hollow-core regions 1311, 2311, respectively, and thus adjust the impedance of the ground terminals 11, 21 and the signal terminals 12, 22. Moreover, since the ground terminals 11, 21 and the signal terminals 12, 22 in the hollow-core regions 1311, 2311 of the frames 131, 231 are fully exposed, the terminal structures 1, 2 are conducive to simplifying the structure of a die for use in a manufacturing process, prolonging the service life of the die, speeding up the manufacturing process, and simplifying the process flow of the manufacturing process. Also, according to the present invention, the terminal structure 1 is characterized advantageously in that the ground electrical connection element 14 gets connected to the frame 131 through the first connection portion 1313, whereas the first connection portion 1313 connects the ground electrical connection element 24 of another terminal structure 2 and the first connection portion 2313 of another terminal structure 2 so as to connect the two terminal structures 1, 2. In addition, to connect two terminal structures 1, 2, the frame 131 has a plurality of connection posts, whereas the frame 231 has a plurality of connection slots, wherein the cross-section area of each of the connection posts is slightly larger than the cross-section area of each of the connection slots, such that the connection posts can be inserted forcefully into the connection slots, respectively, thereby allowing the two frames 131, 231 to connect with each other and clamp the ground electrical connection elements 14, 24, respectively.

Figure 10:
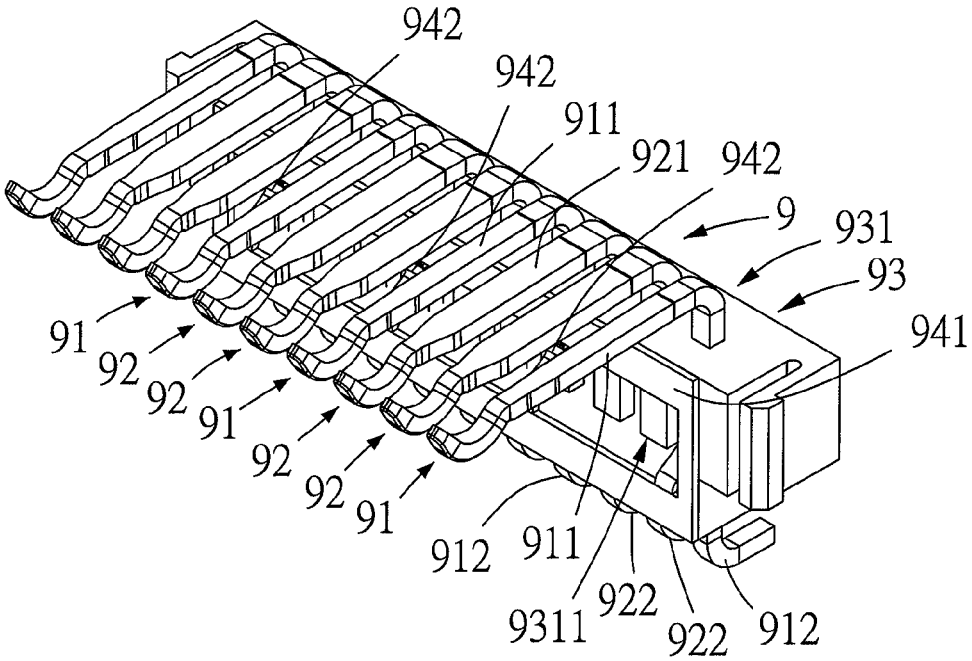
FIG. 10 is a perspective view of the connection elements disposed at the ground electrical connection segments and the signal electrical connection segments according to a preferred embodiment of the present invention.
Figure 11:
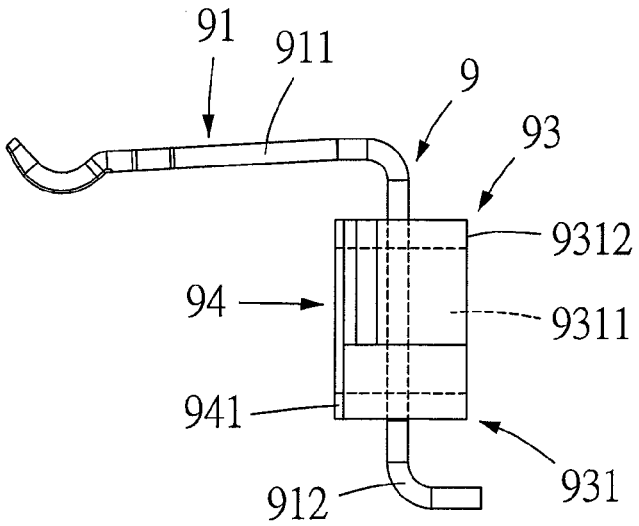
FIG. 11 is a right side view of FIG. 10.

Referring to FIG. 2, FIG. 10, and FIG. 11, as regards the terminal structure, the frames 131, 231 are disposed at the resilient ground electrical contact segments 111, 211 and the resilient signal electrical contact segments 121, 221 or the frame 931 are disposed at the ground electrical connection segments 912 and the signal electrical connection segments 922. According to the present invention, the terminal structures 1, 2, 9 are applicable to electrical connectors of different structures.

Referring to FIG. 2, FIG. 6, and FIG. 7, as regards the terminal structure, the frames 131, 231 are rectangular. The ground terminals 11, 21 and the signal terminals 12, 22 are longitudinally and penetratingly fixed to the two longer sides of the frames 131, 231 and pass through the hollow-core regions 1311, 2311 of the frames 131, 231, respectively. According to the present invention, the terminal structures 1, 2 can be easily positioned in the electrical connector. In addition, the connection posts or the connection slots are disposed at four corners at one of opened sides 1312, 2312 of the frames 131, 231, respectively.

Figure 12:
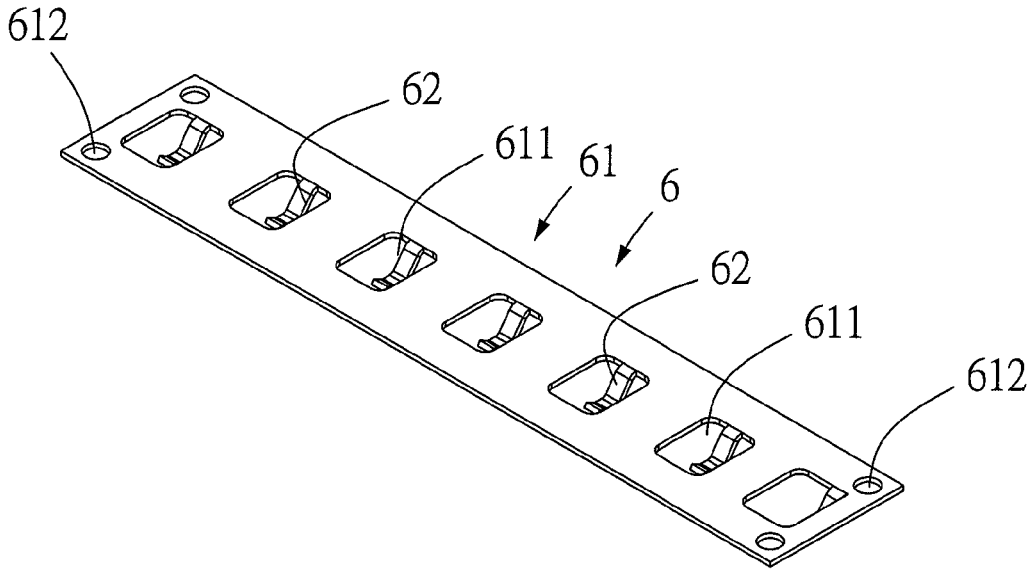
FIG. 12 is another perspective view of the ground electrical connection elements according to a preferred embodiment of the present invention.

Referring to FIG. 2 through FIG. 7, and FIG. 12, as regards the terminal structure, the ground bodies 141, 241, 61 are each a plate and each have at least a hollow-core ground region 1411, 2411, 611, respectively. The resilient ground pins 142, 242, 62 are disposed at the hollow-core ground regions 1411, 2411, 611 to connect with the inner edges of the ground bodies 141, 241, 61, respectively, and are in electrical contact with the ground terminals 11, 21 through the hollow-core regions 1311, 2311 of the frames 131, 231, respectively. The resilient ground pins 142, 242 are disposed in the hollow-core ground regions 1411, 2411, respectively, as shown in FIG. 2. The resilient ground pin 62 is disposed in the hollow-core ground region 611, as shown in FIG. 12. In addition, referring to FIG. 2 and FIG. 12, the ground bodies 141, 241, 61 are each a plate and each have at least a hollow-core ground region 1411, 2411, 611 and the second connection portions 1412, 2412, 612, wherein the second connection portions 1412, 2412, 612 each have a plurality of connection holes. The ground bodies 141, 241, 61 overlap the frames 131, 231, respectively. The second connection portions 1412, 2412, 612 are connected to the first connection portions 1313, 2313, respectively. The hollow-core ground regions 1411, 2411, 611 of the ground bodies 141, 241, 61 are in communication with the hollow-core regions 1311, 2311 of the frames 131, 231, respectively. The resilient ground pins 142, 242, 62 are disposed in the hollow-core ground regions 1411, 2411, 611 to connect with the inner edges of the ground bodies 141, 241, 61, respectively, and are in electrical contact with the ground terminals 12, 22 through the hollow-core regions 1311, 2311 of the frames 131, 231, respectively. Hence, the ground electrical connection elements 14, 24, 6 get connected to the first connection portions 1313, 2313 of the frames 131, 231 through the second connection portions 1412, 2412, 612 of the ground bodies 141, 241, 61, respectively, for example, by inserting connection posts into connection holes, respectively, such that the resilient ground pins 142, 242, 62 of the ground electrical connection elements 14, 24, 6 are in electrical contact with the ground terminals 11, 21 through the hollow-core ground regions 1411, 2411, 611 of the ground bodies 141, 241, 61 and the hollow-core regions 1311, 2311 of the frames 131, 231, respectively.

Referring to FIG. 2 through FIG. 9, the present invention in the second aspect provides an electrical connector which comprises a casing 3 and two terminal structures 1, 2. The terminal structures 1, 2 are connected to each other through the connection elements 13, 23, respectively. The connection elements 13, 23 are connected to each other through the first connection portions 1313, 2313, respectively. For instance, the connection element 13 has a plurality of connection posts, whereas the connection element 23 has a plurality of connection slots, wherein the cross-sectional areas of the connection posts are slightly larger than the cross-sectional areas of the connection slots, such that the connection posts can be inserted forcefully into the connection slots, respectively, to allow the connection elements 13, 23 to be connected to each other. In addition, the ground terminals 11, 21 and the signal terminals 12, 22 of the terminal structures 1, 2 are bent to take on different shapes. When the terminal structures 1, 2 are connected to each other, the resilient ground electrical contact segments 111, 211 are above and are spaced apart from the resilient signal electrical contact segments 121, 221 and arranged transversely in a manner to form a clamping cavity for clamping an external plug or receptacle (not shown), whereas the ground electrical connection segments 112, 212 are in front of and are spaced apart from the signal electrical connection segments 122, 222 and arranged transversely in a manner to electrically connect with a plurality of solder pads 51 of the circuit board 5, respectively. An insertion slot 31 is disposed on a front side of the casing 3. The casing 3 has therein a receiving passage 32 which is in communication with the insertion slot 31. The resilient ground electrical contact segments 111, 211, the resilient signal electrical contact segments 121, 221, and the connection elements 13, 23 of the terminal structures 1, 2 are disposed in the receiving passage 32. The resilient ground electrical contact segments 111, 211 and the resilient signal electrical contact segments 121, 221 face the insertion slot 31. The ends of the ground electrical connection segments 112, 212 and the ends of the signal electrical connection segments 122, 222 of the terminal structures 1, 2 are exposed from the casing 3 to electrically connect with the solder pads 51 of the circuit board 5, respectively.

As described before, according to the present invention, the electrical connector gets connected to the ground terminals 11, 21 through the ground electrical connection elements 14, 24, respectively, so as to improve the resonance thereof. According to the present invention, the terminal structures 1, 2 of the electrical connector is characterized advantageously in that the ground terminals 11, 21 and the signal terminals 12, 22 in the hollow-core regions 1311, 2311 of the frames 131, 231 are fully exposed and thus are not enclosed by any plastic structure; hence, according to the present invention, the electrical connector is conducive to reduction of signal loss. Furthermore, in the situation where the appearance of the frames 131, 231 remains unchanged, the electrical connector is characterized advantageously in that, by changing the size of the hollow-core regions 1311, 2311, it is feasible to change the length of the exposed portion of the ground terminals 11, 21 and the signal terminals 12, 22 in the hollow-core regions 1311, 2311, respectively, so as to adjust the impedance of the ground terminals 11, 21 and the signal terminals 12, 22. In addition, since the ground terminals 11, 21 and the signal terminals 12, 22 in the hollow-core regions 1311, 2311 of the frames 131, 231 are fully exposed, the electrical connector of the present invention is conducive to simplifying the structure of a die for use in a manufacturing process, prolonging the service life of the die, speeding up the manufacturing process, and simplifying the process flow of the manufacturing process.

Referring to FIG. 2 through FIG. 7, the second connection portions 1412, 2412 of the ground electrical connection elements 14, 24 come in the form of a plurality of connection holes penetrable by the connection posts, respectively, such that the ground electrical connection elements 14, 24 are clamped and fixed in place between the connection elements 13, 23, respectively.

Referring to FIG. 2, FIG. 6 through FIG. 9, the electrical connector further comprises a mounting base 4 which has a plurality of recesses 41 spaced apart from each other transversely. The recesses 41 are each inverted U-shaped, as shown in FIG. 2. Upon completion of assembly, the ground electrical connection segments 112, 212 and the signal electrical connection segments 122, 222 of the terminal structures 1, 2 are each inverted U-shaped so as to be disposed in the recesses 41, respectively. The mounting base 4 is disposed at the rear of the casing 3 to stop the displacement of the terminal structures 1, 2, such that the terminal structures 1, 2 are firmly disposed at the casing 3. The ends of the ground electrical connection segments 112, 212 and the signal electrical connection segments 122, 222 of the terminal structures 1, 2 are exposed from the mounting base 4 to connect electrically with the solder pads 51 of the circuit board 5, respectively.

Referring to FIG. 2, FIG. 6 through FIG. 9, as regards the electrical connector, a supporting element 33, such as a supporting plate, is disposed at each of the two sides of the rear of the casing 3. The supporting elements 33 each have an engaging slot 331 (or an engaging arm). The two sides of the mounting base 4 each have an engaging arm 42 (or an engaging slot). The engaging arms 42 are engaged with the engaging slots 441, respectively, such that the mounting base 4 is fixed to the rear of the casing 3 to thereby stop the terminal structures 1, 2 from moving, thereby allowing the terminal structures 1, 2 to be firmly disposed at the casing 3.

Figure 8:
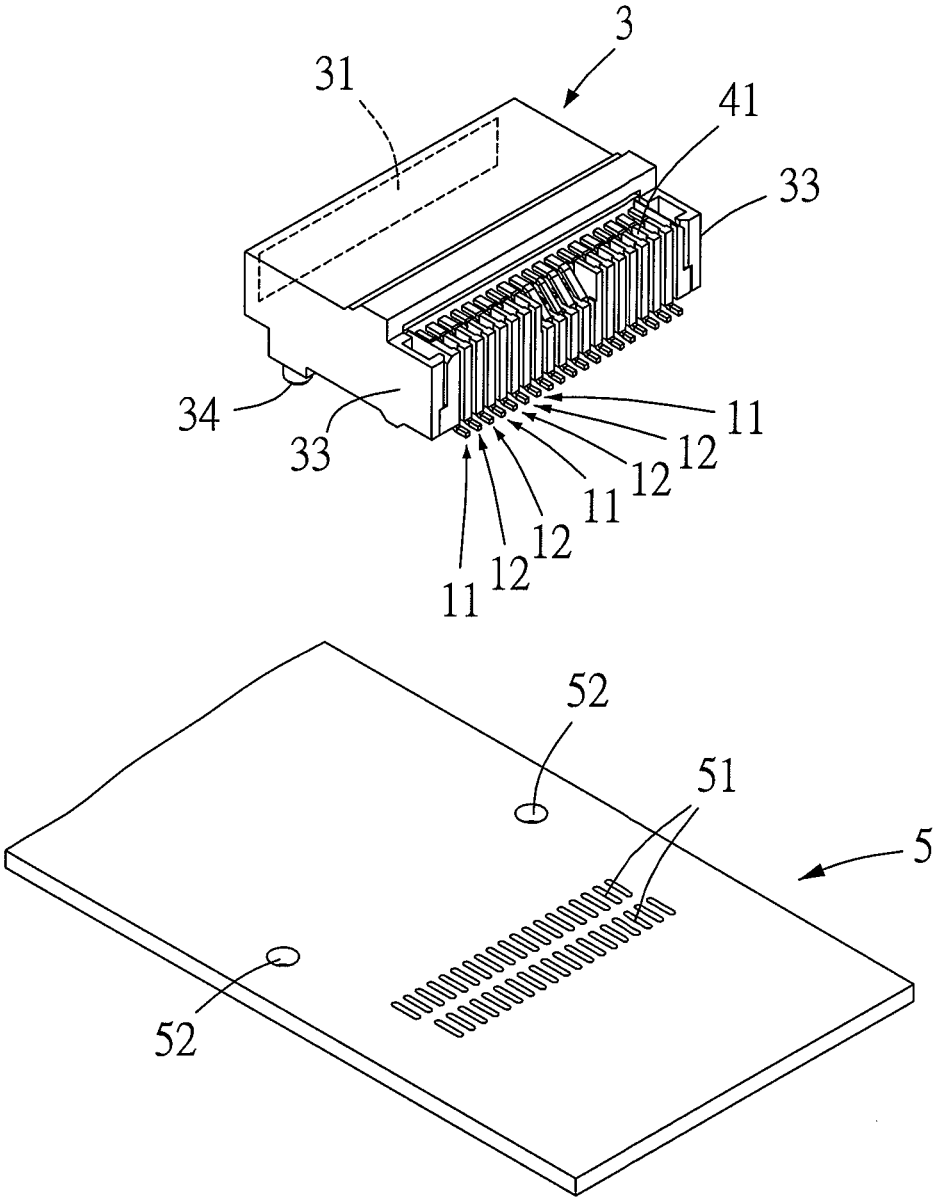
FIG. 8 is an exploded view of an electrical connector and a circuit board according to a preferred embodiment of the present invention.
Figure 9:
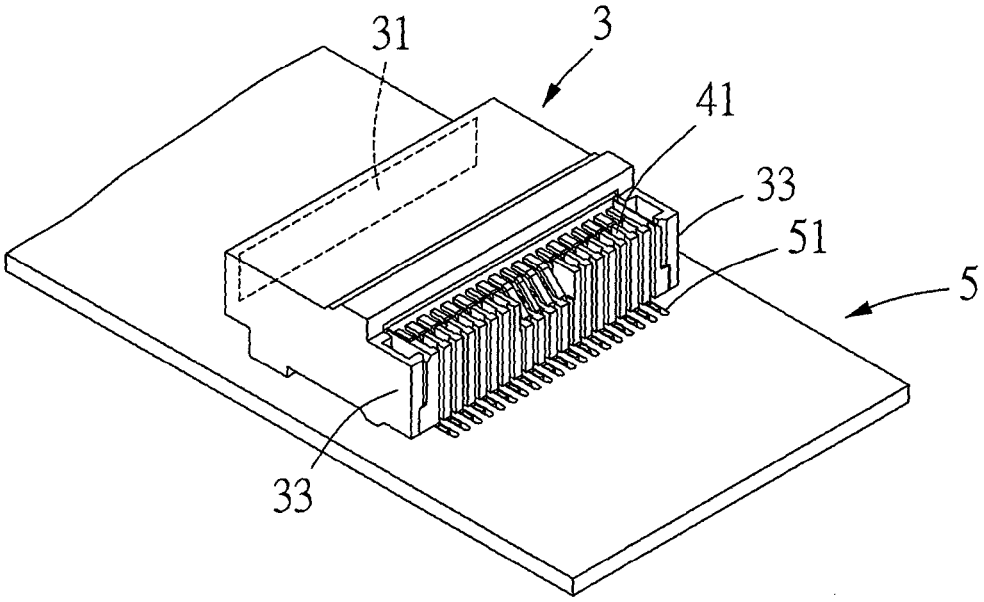
FIG. 9 is an assembled perspective view of the electrical connector and the circuit board according to a preferred embodiment of the present invention.

Referring to FIG. 2, FIG. 8 and FIG. 9, as regards the electrical connector, a mounting portion 34 is disposed at the bottom of the casing 3. The mounting portion 34 has two fixing posts which flank the bottom of the casing 3. The electrical connector of the present invention is characterized advantageously in that: the fixing posts are inserted forcefully into two fixing holes 52 of the circuit board 5, respectively, such that the electrical connector of the present invention can be connected to the circuit board 5.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. An electrical connector, comprising:

two terminal structures, each terminal structure comprises a plurality of ground terminals having resilient ground electrical contact segments and ground electrical connection segments connected to the resilient ground electrical contact segments, respectively;

a plurality of signal terminals having resilient signal electrical contact segments and signal electrical connection segments connected to the resilient signal electrical contact segments, respectively, wherein the ground terminals alternate with the signal terminals transversely;

a connection element for connecting each said ground terminal to a corresponding one of the signal terminals, wherein the connection element is a frame with a hollow-core region;

a ground electrical connection element having a ground body and at least a resilient ground pin, wherein the ground body is in connection with the frame, wherein the at least a resilient ground pin is in electrical contact with the ground terminals, wherein the connection elements are connected to each other; and a casing having an insertion slot disposed on a front side of the casing, wherein the terminal structure is disposed at the casing, wherein the resilient ground electrical contact segments and the resilient signal electrical contact segments face the insertion slot, wherein ends of the ground electrical connection segments and ends of the signal electrical connection segments are exposed from the casing.

2. The electrical connector of claim 1, wherein the connection elements clamp the ground electrical connection elements.

3. The electrical connector of claim 1, further comprising a mounting base having a plurality of recesses spaced apart from each other transversely, wherein the ground electrical connection segments and the signal electrical connection segments are disposed in the recesses, respectively, wherein the mounting base is disposed on a rear side of the casing, wherein ends of the ground electrical connection segments and ends of the signal electrical connection segments are exposed from the mounting base.

4. The electrical connector of claim 3, wherein a supporting element is disposed on each of two sides at a rear of the casing, wherein the supporting elements each have an engaging slot, wherein an engaging arm is disposed on each of two sides of the mounting base, wherein the engaging arms are engaged with the engaging slots, respectively, such that the mounting base is fixed to the rear of the casing.

5. The electrical connector of claim 3, wherein a supporting element is disposed on each of two sides at a rear of the casing, wherein the supporting elements each have an engaging arm, wherein an engaging slot is disposed on each of two sides of the mounting base, wherein the engaging arms are engaged with the engaging slots, respectively, such that the mounting base is fixed to the rear of the casing.

6. A terminal structure, comprising:

a plurality of ground terminals having resilient ground electrical contact segments and ground electrical connection segments connected to the resilient ground electrical contact segments, respectively;

a plurality of signal terminals having resilient signal electrical contact segments and signal electrical connection segments connected to the resilient signal electrical contact segments, respectively, wherein the ground terminals alternate with the signal terminals transversely;

a connection element for connecting each said ground terminal to a corresponding one of the signal terminals, wherein the connection element is a frame with a hollow-core region; and a ground electrical connection element having a ground body and at least a resilient ground pin, wherein the ground body is in connection with the frame, wherein the at least a resilient ground pin is in electrical contact with the ground terminals, wherein the ground terminals and the signal terminals are longitudinally and penetratingly fixed to two sides of the frame and pass through the hollow-core region of the frame, wherein a first connection portion is disposed on one of two opened sides of the frame, wherein the ground body is in connection with the first connection portion, wherein the first connection portion has one of a plurality of connection posts and a plurality of connection slots.

7. The terminal structure of claim 6, wherein every two signal terminals are disposed between two said ground terminals.

8. The terminal structure of claim 6, wherein the ground body has at least a hollow-core ground region, wherein the resilient ground pin is disposed in the hollow-core ground region to connect with an inner edge of the ground body and is in electrical contact with the ground terminals through the hollow-core region.

9. A terminal structure, comprising:

a plurality of ground terminals having resilient ground electrical contact segments and ground electrical connection segments connected to the resilient ground electrical contact segments, respectively;

a plurality of signal terminals having resilient signal electrical contact segments and signal electrical connection segments connected to the resilient signal electrical contact segments, respectively, wherein the ground terminals alternate with the signal terminals transversely;

a connection element for connecting each said ground terminal to a corresponding one of the signal terminals, wherein the connection element is a frame with a hollow-core region; and a ground electrical connection element having a ground body and at least a resilient ground pin, wherein the ground body is in connection with the frame, wherein the at least a resilient ground pin is in electrical contact with the ground terminals, wherein the frame is disposed at the resilient ground electrical contact segments and the resilient signal electrical contact segments, wherein the frame is disposed at the ground electrical connection segments and the signal electrical connection segments.

10. The terminal structure of claim 9, wherein every two signal terminals are disposed between two said ground terminals.

11. The terminal structure of claim 9, wherein the ground body has at least a hollow-core ground region, wherein the resilient ground pin is disposed in the hollow-core ground region to connect with an inner edge of the ground body and is in electrical contact with the ground terminals through the hollow-core region.

12. A terminal structure, comprising:

a plurality of ground terminals having resilient ground electrical contact segments and ground electrical connection segments connected to the resilient ground electrical contact segments, respectively;

a plurality of signal terminals having resilient signal electrical contact segments and signal electrical connection segments connected to the resilient signal electrical contact segments, respectively, wherein the ground terminals alternate with the signal terminals transversely;

a connection element for connecting each said ground terminal to a corresponding one of the signal terminals, wherein the connection element is a frame with a hollow-core region; and a ground electrical connection element having a ground body and at least a resilient ground pin, wherein the ground body is in connection with the frame, wherein the at least a resilient ground pin is in electrical contact with the ground terminals, wherein the frame is rectangular, wherein the ground terminals and the signal terminals are longitudinally and penetratingly fixed to two longer sides of the frame and pass through the hollow-core region of the frame.

13. The terminal structure of claim 12, wherein every two signal terminals are disposed between two said ground terminals.

14. The terminal structure of claim 12, wherein the ground body has at least a hollow-core ground region, wherein the resilient ground pin is disposed in the hollow-core ground region to connect with an inner edge of the ground body and is in electrical contact with the ground terminals through the hollow-core region.

15. A terminal structure, comprising:

a plurality of ground terminals having resilient ground electrical contact segments and ground electrical connection segments connected to the resilient ground electrical contact segments, respectively;

a plurality of signal terminals having resilient signal electrical contact segments and signal electrical connection segments connected to the resilient signal electrical contact segments, respectively, wherein the ground terminals alternate with the signal terminals transversely;

a connection element for connecting each said ground terminal to a corresponding one of the signal terminals, wherein the connection element is a frame with a hollow-core region; and a ground electrical connection element having a ground body and at least a resilient ground pin, wherein the ground body is in connection with the frame, wherein the at least a resilient ground pin is in electrical contact with the ground terminals, wherein the ground terminals and the signal terminals are longitudinally and penetratingly fixed to two sides of the frame and pass through the hollow-core region of the frame, wherein a first connection portion is disposed on one of two opened sides of the frame, wherein the ground body is in connection with the first connection portion, wherein the first connection portion has one of a plurality of connection posts and a plurality of connection slots, wherein the ground body has at least a hollow-core ground region and a second connection portion, with the ground body overlapping the frame, wherein the second connection portion is connected to the first connection portion, wherein the resilient ground pin is disposed in the hollow-core ground region to connect with an inner edge of the ground body and is in electrical contact with the ground terminals through the hollow-core region.

16. The terminal structure of claim 15, wherein every two signal terminals are disposed between two said ground terminals.

17. The terminal structure of claim 15, wherein the ground body has at least a hollow-core ground region, wherein the resilient ground pin is disposed in the hollow-core ground region to connect with an inner edge of the ground body and is in electrical contact with the ground terminals through the hollow-core region.

* * * * *